US006143112A

United States Patent [19]

Isowa

[11] Patent Number: 6,143,112

[45] Date of Patent: Nov. 7, 2000

[54] METHOD AND APPARATUS FOR PRODUCING SINGLE FACE CORRUGATED WEB

[75] Inventor: Eiichi Isowa, Nagoya, Japan

[73] Assignee: Kabushiki Kaisha Isowa, Aichi, Japan

[21] Appl. No.: 09/134,137

[22] Filed: Aug. 14, 1998

[30] Foreign Application Priority Data

Apr. 3, 1998 [JP] Japan ..... 10-108778

[51] Int. Cl.[7] ..... B31F 1/28

[52] U.S. Cl. ..... 156/205; 156/472

[58] Field of Search ..... 156/470, 471, 156/472, 473, 205, 210; 226/111

[56] References Cited

U.S. PATENT DOCUMENTS

| | | | |
|---|---|---|---|
| 1,186,998 | 6/1916 | Langston | 156/472 |
| 2,979,112 | 4/1961 | Wilson | 156/473 |
| 3,837,550 | 9/1974 | Levy | 226/111 |
| 3,920,496 | 11/1975 | Wilkinson et al. | 156/210 |
| 4,319,947 | 3/1982 | Tokuno | 156/472 |
| 5,337,944 | 8/1994 | Shiba | 226/108 |
| 5,389,183 | 2/1995 | Seki et al. | 156/472 |
| 5,614,048 | 3/1997 | Barny et al. | 156/210 |

*Primary Examiner*—Michael W. Ball
*Assistant Examiner*—Barbara J. Musser
*Attorney, Agent, or Firm*—Koda & Androlia

[57] ABSTRACT

The present invention relates to an apparatus for producing single face corrugated web, which comprises the first corrugating roll and second corrugating roll, and further comprises the first smoothing roll provided in a feeding channel of a liner web, a second smoothing roll provided in a feeding channel of a single face corrugated web, and a third smoothing roll provided in a feeding channel of the liner web between the first smoothing roll and the second smoothing roll, wherein the third smoothing roll is constructed so that the liner web fed between the first smoothing roll and the second smoothing roll is brought, by tension, into contact with the outer circumferential surface of the second corrugating roll over an appointed length.

10 Claims, 10 Drawing Sheets

METHOD AND APPARATUS FOR PRODUCING SINGLE FACE CORRUGATED WEB

BACKGROUND OF THE INVENTION

1. Field of the Invention

The present invention relates to a method and an apparatus for producing single face corrugated web by adhering a liner web to a medium web corrugated by causing the same to pass through the first corrugating roll and the second corrugating roll, on the outer circumference of which corrugated flutes are formed.

2. Description of the Related Art

An apparatus (so-called single facer) for producing single face corrugated web having a liner web adhered to corrugation crests of a medium web formed to be corrugated is such that the first corrugating roll and second corrugating roll, the outer circumferences of which are have corrugated flutes, are disposed in an up and down relationship so as to be rotatable while they are being engaged at the abovementioned flutes, and a pressure roll is pressure-contacted to the second corrugating roll via the abovementioned medium web and liner web. That is, the medium web is supplied between the first corrugating roll and the second corrugating roll and is provided with appointed corrugated flutes while passing between both rolls. Starch-based glue is coated onto the corrugation crests, by a gluing roller secured to a gluing mechanism. Furthermore, a liner web is supplied from the opposite side of the medium web via the pressure roll, wherein the abovementioned liner web is pressure-contacted to the crests of the medium web and adhered to the medium web between the abovementioned pressure roll and the second corrugating roll, thereby producing a single face corrugated web.

A pressure roll used for a single face corrugated web producing apparatus consists of a metal roll of a large diameter, and the abovementioned roller is opposite to the second corrugating roll with a clearance retained therebetween. And by giving appointed nipping pressure to a medium web and liner web passing between the second corrugating roll and the pressure roll, both of them are adhered to each other at the corrugation crests of the medium web, to which glue is coated. In this case, since flutes consisting of a crest and a trough in continuation are formed at an appointed pitch on the outer circumference of the second corrugating roll, the center of rotation of both rolls slightly changes when the roll pressure-contacting position is made transient from a crest to a trough or from a trough to a crest. As a result of cyclic proximity and separation of the center of rotation of both rolls along with the rotation of both rolls, great vibrations and high noise are generated when producing single face corrugated web, whereby the factory environment is excessively worsened. Furthermore, the crests of the second corrugating roll are cyclically brought into contact with the surface of a pressure roll, resulting from cyclic proximity and separation of the rotation center of both rolls with impacting generated (so-called hammering phenomena occur). Therefore, such a problem arises, by which press lines (so-called press marks) are given to the liner weburface of single face corrugated web produced, in the lateral direction at a pitch of the crests of the second corrugating roll, resulting in a lowering of the commodity value.

Each of the abovementioned various problems results due to the nipping pressure being necessarily set to a greater level since, in a conventional apparatus for producing single face corrugated web, the medium web and liner web are nipped at only one point where the second corrugating roll and pressure roll are opposed to each other. Therefore, as a means to cope with this, such a proposal was made, in which a plurality of pressure rolls are disposed with a spacing therebetween in the circumferential direction of the second corrugating roll, the nipping pressure is set to a smaller value at each of the pressure rolls so that a greater nipping pressure is not given to the medium web and liner web, thereby press marks attached to single face corrugated web are suppressed. Furthermore, such a proposal was made, in which an endless belt is disposed so as to freely travel along the outer circumference of the second corrugating roll, whereby the medium web and liner web are caused to be brought into facial contact with the second corrugating roll in order to suppress generation of vibration, noise or press marks.

However, in any one of the abovementioned countermeasures, since the medium web and liner web are pressure-contacted to the second corrugating roll by a mechanical pressing means, it is impossible to completely eliminate press marks. Furthermore, since the respective pressure rolls are pressed with appointed nipping pressure in a case where a plurality of pressure rolls are used, it is unavoidable for the abovementioned hammering phenomena to be generated in each pressure roll, and a small vibration and noise are generated at each of the pressure rolls, wherein they are multiplied and cause a new problem from which great vibrations and high level noise result. Furthermore, in a case where an endless belt is used, the belt is worn out in time, and it is necessary to replace it periodically. It is pointed out that such a fault arises, by which the running cost is increased. And there is a shortcoming where a "shining" is produced at the liner webide since the endless belt is brought into contact with the liner web.

SUMMARY OF THE INVENTION

In the industry of producing corrugated board, it was common sense in prior arts that preparation of a certain mechanical pressing means was required, as described above, in order to adhere the medium web and liner web together. Therefore, the present applicant actively studied and developed a novel method and a novel apparatus for producing a single face corrugated web, freeing from common sense in the art of this field. As a result, he confirmed that the present method and apparatus for producing single face corrugated web has the ability to adhere the medium web and liner web together without the use of any mechanical pressing means, and files the same method for a patent.

That is, the present invention has been proposed to favorably solve the themes internally existing in the prior arts described above, and it is therefore an object of the invention to provide a novel method and apparatus for producing a single face corrugated web, which, when producing single face corrugated web having a medium web and a liner web adhered to each other, has the ability to generate no press mark on the liner webide and to decrease vibration and noise.

DETAILED DESCRIPTION OF THE PREFERRED EMBODIMENTS

A description is given of a preferred embodiment of a method and apparatus for producing single face corrugated web according to the invention with reference to the accompanying drawings.

Figure 1:
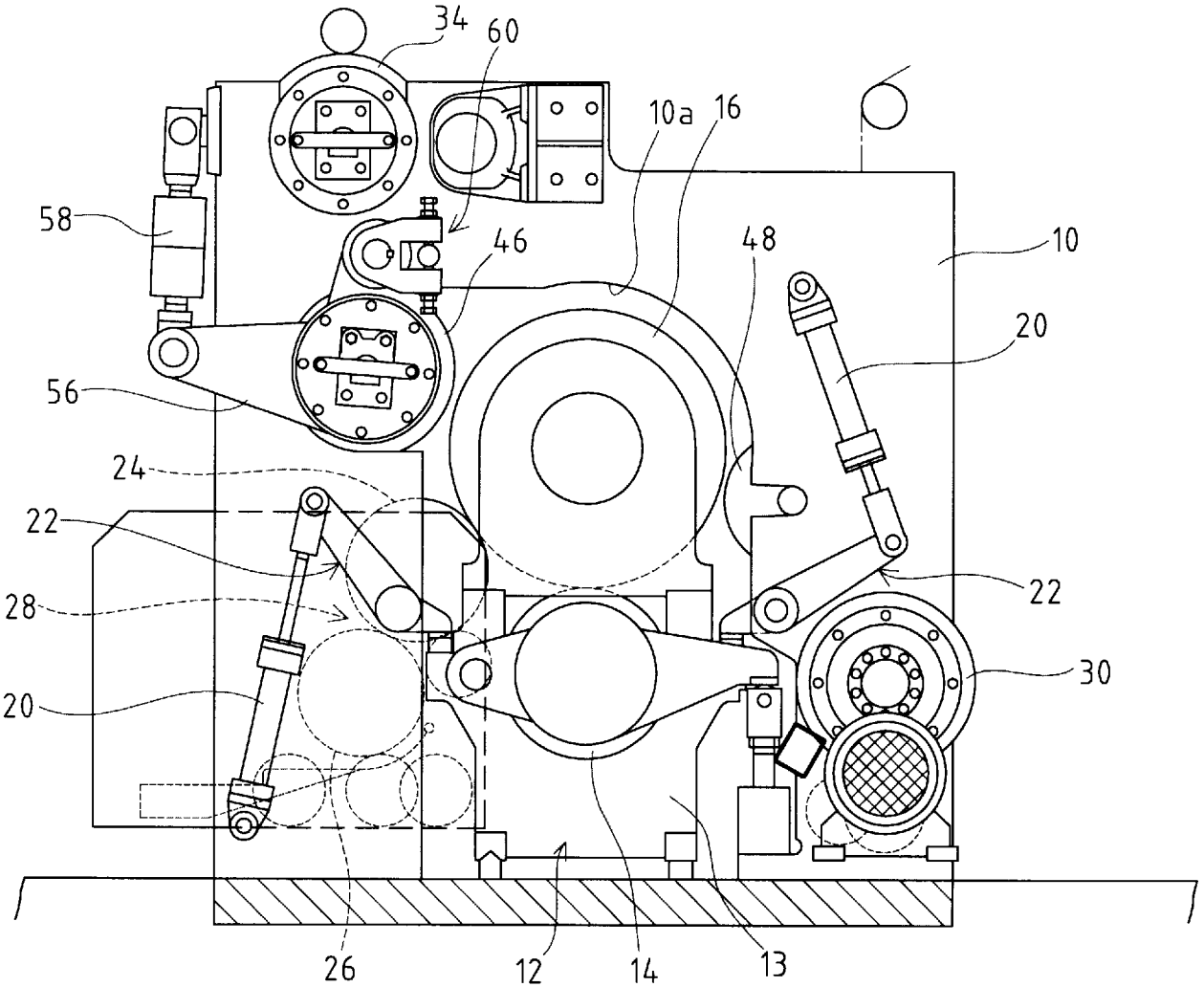
FIG. 1 is a rough side elevational view showing an apparatus for producing single face corrugated web according to an embodiment of the invention.

FIG. 1 roughly shows a construction of a single face corrugated web according to the embodiment, wherein an opening 10*a* is, respectively, formed at a pair of main frames 10,10 (only one is shown in FIG. 1) which is spaced at an appointed distance in the width direction crossing the sheet feeding direction, and a carrier 12 movably confronts in the width direction at a portion where the openings 10*a*, 10*a* are arranged. The carrier 12 is provided with a pair of sub frames 13,13 which are spaced at an appointed distance in the width direction. The first corrugating roll 14 having a corrugated fluted portion formed on its outer circumferential surface and the second roll 16 having a corrugated fluted portion formed on its outer circumferential surface, as well, are pivotally supported between both sub frames 13,13 and extend in the width direction. Subsequently, it is constructed that, by causing the carrier 12 to move from its operation position inside the main frames 10,10 to its retraction position outside them, maintenance of both rolls 14,16 can be easily performed outside the frames. The center of rotation of the first corrugating roll 14 is positioned right below the center of rotation of the second corrugating roll 16, and the respective corrugated fluted portions are made engageable with each other via a medium web 18 described later (See FIG. 2). Furthermore, a positioning mechanism 22 which is activated by a cylinder 20 is disposed at each of both sides, between which the abovementioned opening 10*a* is placed, outside each of the abovementioned main frames 10, whereby it is constructed that the abovementioned carrier 12 can be positioned and fixed at its operation position by the positioning mechanisms 22, 22.

A gluing mechanism 28 consisting of a gluing roll 24, doctor roll 26, etc. is disposed at the side of the abovementioned first corrugating roll 14 at the moving position and diagonally downward of the second corrugating roll 16 between the abovementioned main frames 10,10. Medium web 18 is supplied from a material paper supplying source (not illustrated) at the right side in FIG. 2 to the area of engagement between the first corrugating roll 14 and second corrugating roll 16 via a roll-like medium web preheater 30 heated with steam, wherein the medium web 18 is corrugated to an appointed shape by passing through the abovementioned area. The corrugated medium web 18 goes upward with the feeding direction reversed, along the outer circumferential surface of the second corrugating roll 16 after their crests are glued by the abovementioned gluing mechanism 28. Furthermore, liner web 32 is supplied from the material paper supplying source (not illustrated) at the left side in FIG. 2 to the second corrugating roll 16 via a roll-like first smoothing roll 34, described later, heated with steam, and is fed upward in such a state that it is adhered to the glued crests of the medium web 18.

Figure 3:
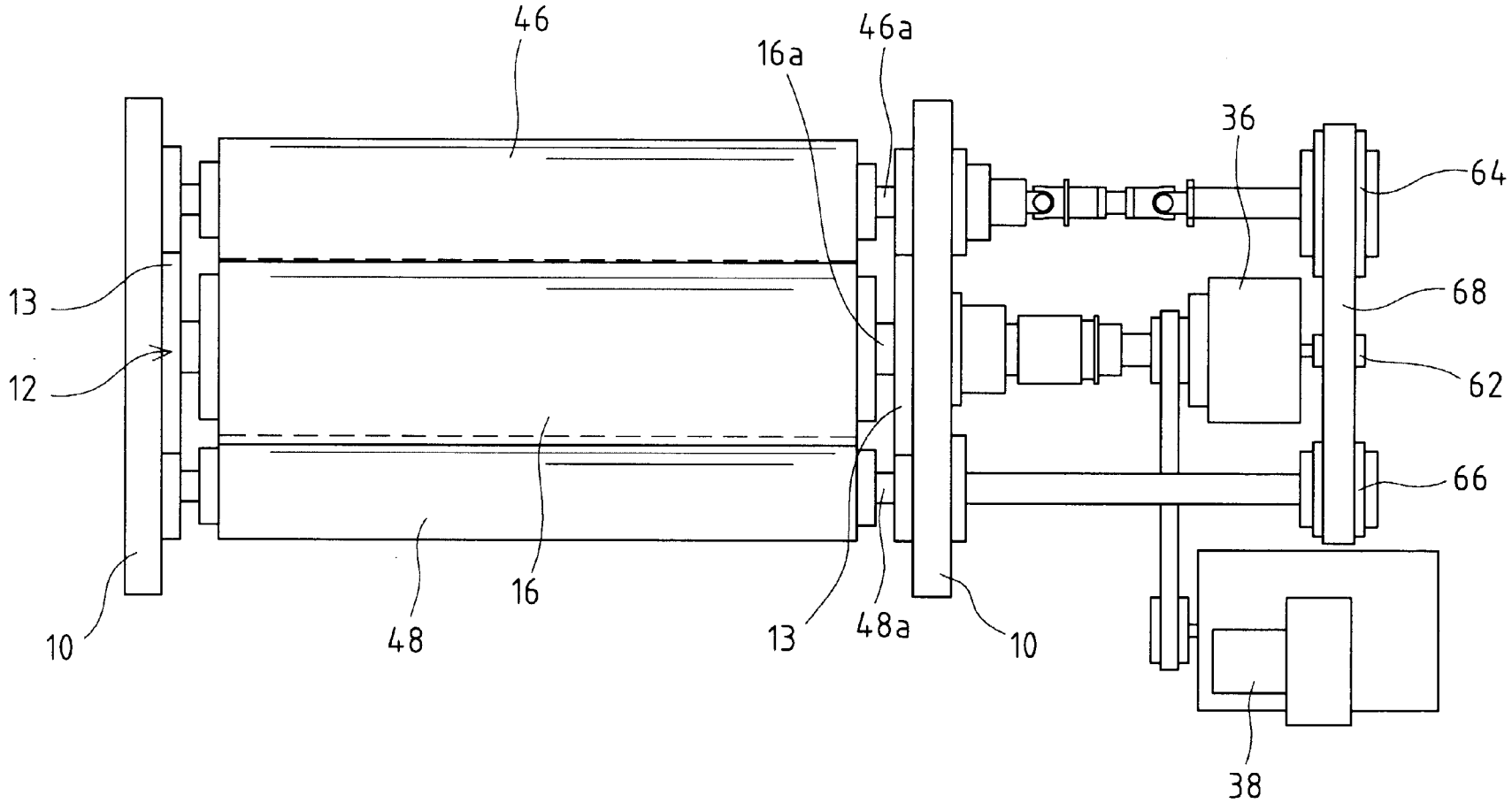
FIG. 3 is a rough configurational view showing a drive system of the second corrugating roll, and the second and third smoothing rolls according to the embodiment.
Figure 4:
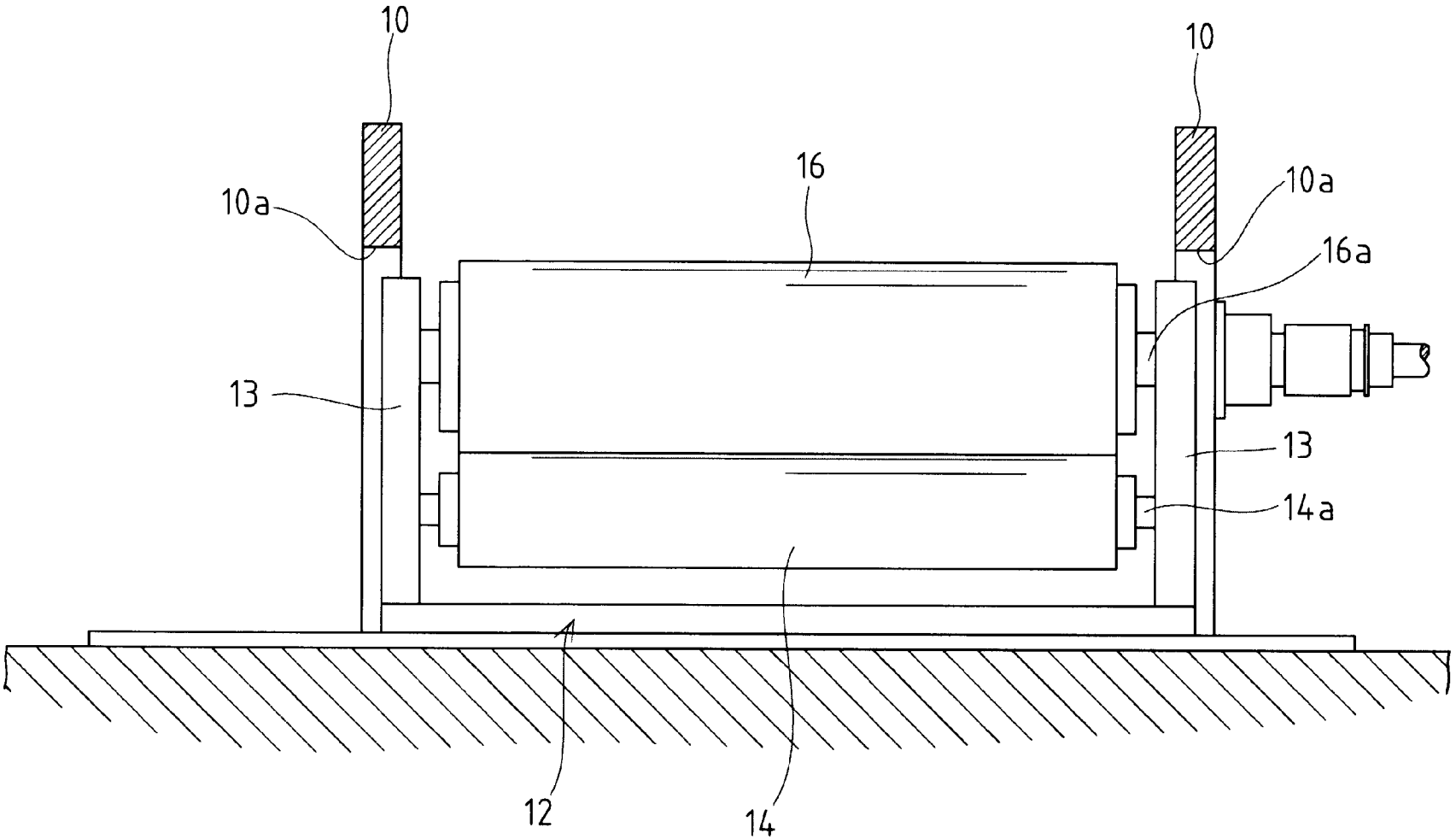
FIG. 4 is a rough configurational view showing a drive relationship between the first corrugating roll and the second corrugating roll according to the embodiment.

The abovementioned second corrugating roll 16 is pivotally supported so that its rotation shaft 1*a* is rotatable with respect to the sub frames 13,13 of the carrier 12, and as shown in FIG. 3, the end portion of the rotation shaft 16*a* outwardly extending from the sub frame 13 at the drive side (the right side in the drawing) is connected to the main drive motor 38 via a speed reducer 36, and is constructed so that the second corrugating roll 16 is driven and rotated at a rotation speed (peripheral speed) which is coincident with the feedrate (production speed) of the medium web 18 and liner web 32. Furthermore, it is constructed so that the first corrugating roll 14, which is pivotally supported via a rotation shaft 14*a* with respect to the sub frames 13,13 of the carrier 12, is driven and rotated in accordance with the second corrugating roll 16 under an action of engagement of the corrugated fluted portion formed at the abovementioned roll 14 with the corrugated fluted portion formed at the second corrugating roll 16.

The diameter $L_2$ of the abovementioned second corrugating roll 16 is set to 150% or more (See FIG. 9) of the diameter $L_1$ of the first corrugating roll 14, and it is constructed so that a greater pressure-contact area of the medium web 18 and liner web 32 pressure-contacted to the outer circumferential surface of the second corrugating roll 16 can be obtained between the second smoothing roll 48 and third smoothing roll 46, both of which are described later. For example, it is preferable that the range of the diameter $L_2$ of the second corrugating roll 16 is from 150% to 200% of the diameter $L_1$ of the first corrugating roll 14.

Figure 5:
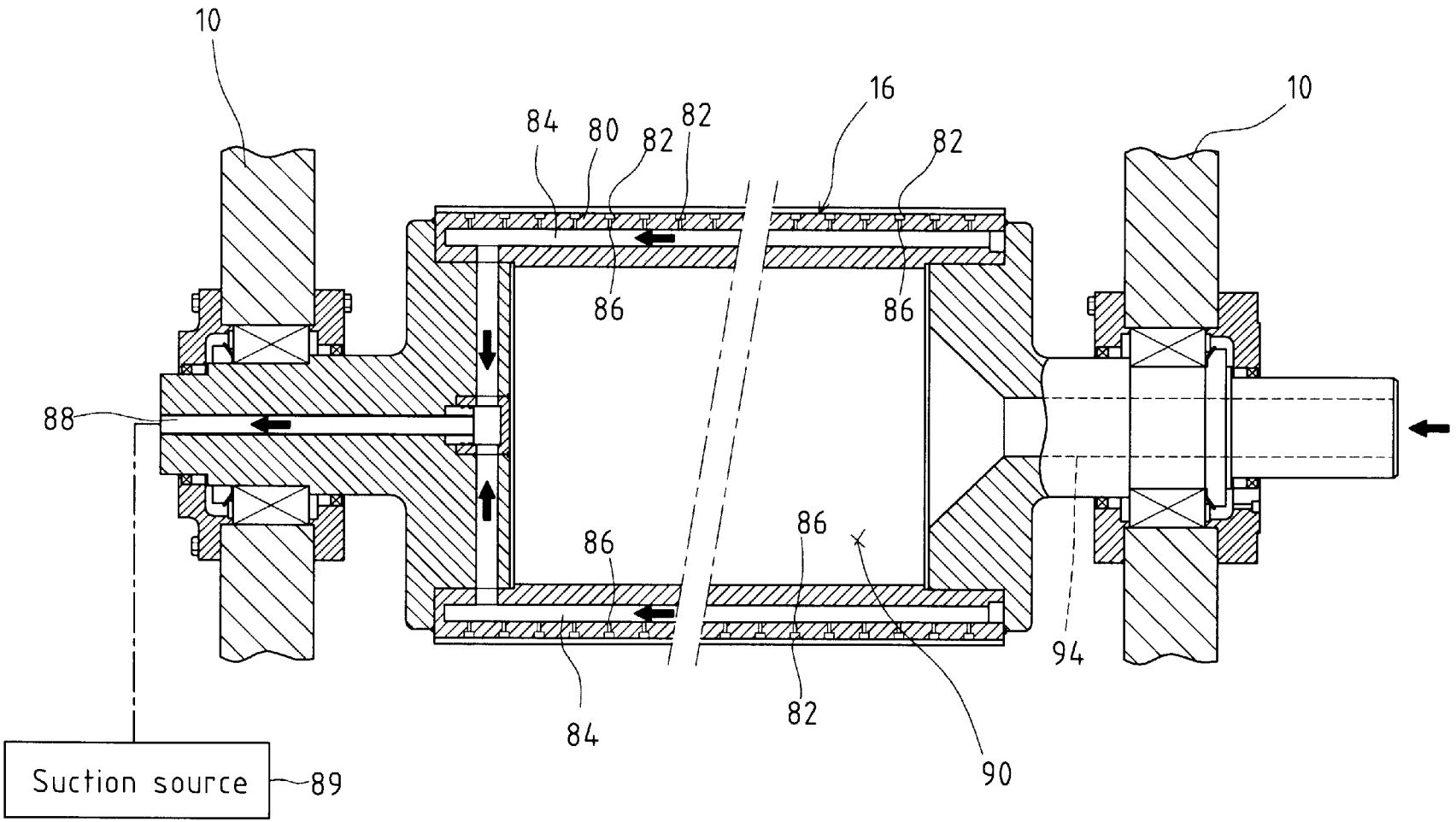
FIG. 5 is a rough longitudinally sectional view of the second corrugating roll according to the embodiment.
Figure 6:
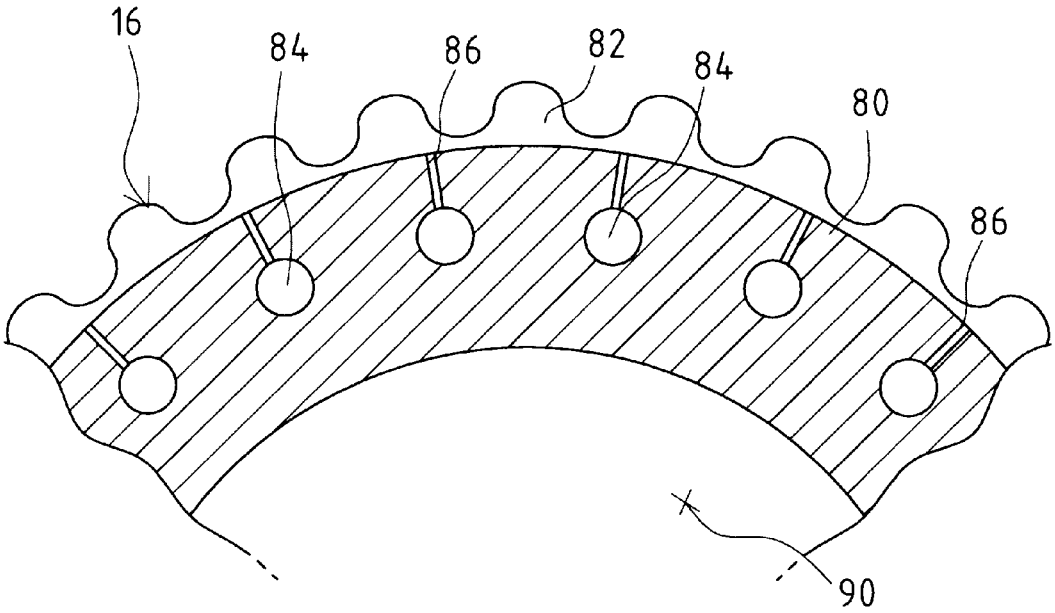
FIG. 6 is a rough longitudinally sectional view showing major parts of the second corrugating roll according to the embodiment.

The abovementioned second corrugating roll 16 is a hollow cylindrical body as shown in FIG. 5 and FIG. 6, wherein a plurality of circumferential grooves 82 are formed at an appointed interval in the axial direction on the outer shell portion 80 thereof, and a plurality of negative pressure paths 84 extending in the axial direction are formed at an appointed interval in the circumferential direction, and a plurality of ventilation portions 86 communicating with the negative pressure paths 84 are drilled at an appointed interval in the circumferential direction at the bottom of the respective circumferential grooves 82. All the negative pressure paths 84 are connected to an adequate suction source 89 via a suction path 88 formed in a one side shaft of the second corrugating roll 16. That is, by making all the negative pressure paths 84 enter a negative state by activating the suction source 89, the pressure of the circumferential grooves 82 is made negative via the respective ventilation ports 86, wherein it is constructed so that medium web 18 wound on the second corrugating roll 16 is fed in a stable state while being adsorbed and retained on the outer circumferential surface of the abovementioned roll 16. Furthermore, since the medium web 18 is adsorbed onto the outer circumferential surface of the second corrugating roll 16 under negative pressure, such an effect is obtained, by which the water content of the glue liquid at the adhered portion of the abovementioned medium web 18 and liner web 32 is sucked in, and drying of the abovementioned glue liquid is accelerated.

A steam chamber 90 is internally sectioned in the abovementioned second corrugating roll 16, and heated steam is supplied from a steam supply source (not illustrated), which is connected to the steam chamber 90 via a steam supplying path 94 formed in the another side shaft of the second corrugating roll 16, into the abovementioned steam chamber 90. That is, heated steam is supplied into the steam chamber 90 of the second corrugating roll 16 to heat the roll surface to an appointed temperature, whereby the medium web 18 in contact with the roll 16 is heated, giving heat to the gluing portion between the medium web 18 and liner web 32 in order to accelerate gelling of a starch-based glue, and the medium web 18 is adhered to a liner web 32 without fail. Furthermore, a steam return path (not illustrated) is formed in one or the other shaft of the second corrugating roll 16, and the heated steam is circulated in the steam chamber 90. Still furthermore, heated steam is also supplied and circulated similarly in the first corrugating roll 14, where heat is given to the gluing portion between the medium web 18 and liner web 32.

The abovementioned medium web preheater 30 is such that its rotation shaft 30*a* is rotatably supported with the main frames 10,10, a drive motor 54 is connected to the end portion of the rotation shaft 30*a* extending from the main frame 10 at the operation side (left side in FIG. 7), and the medium web preheater 30 is driven at an appointed rotation speed (peripheral speed).

Figure 7:
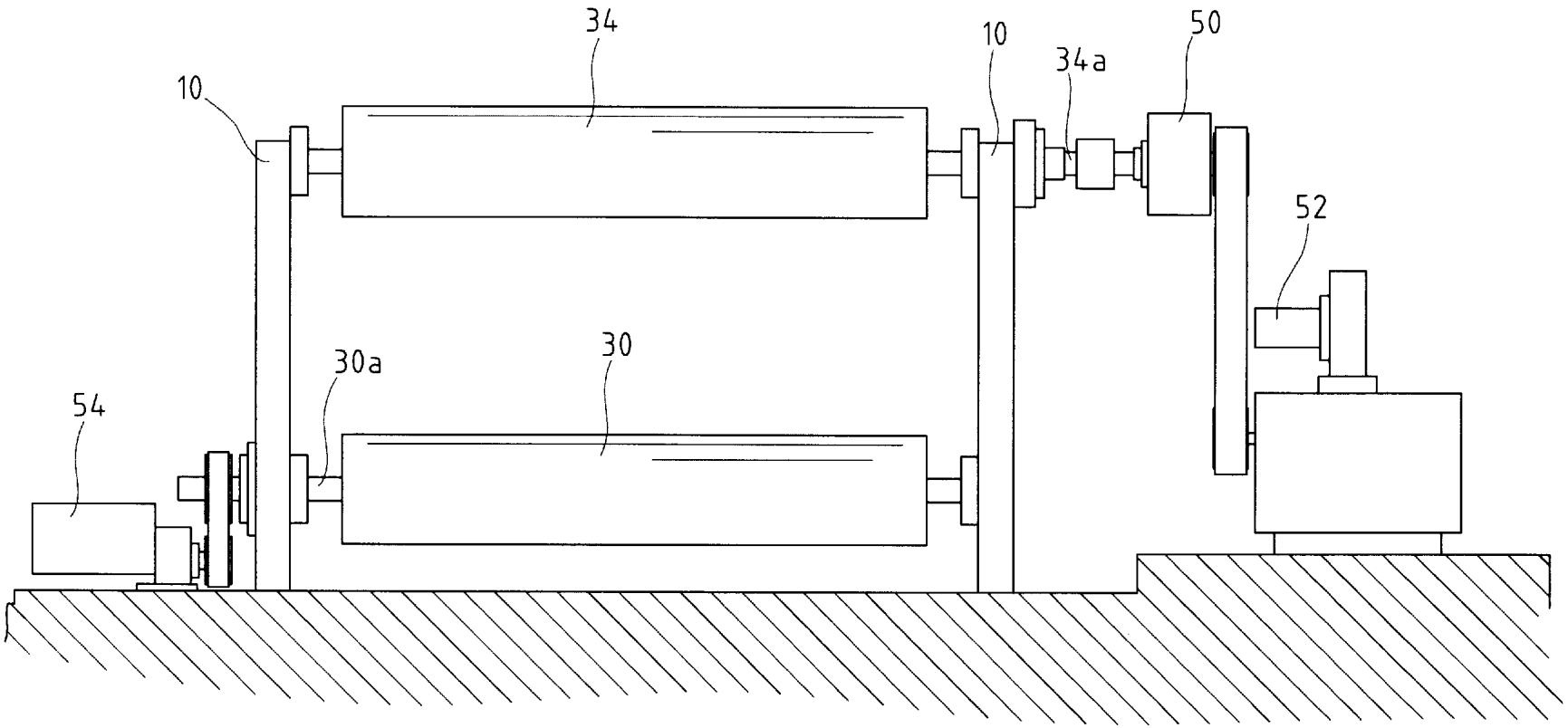
FIG. 7 is a rough configurational view showing a drive system of the first smoothing roll and a preheater for a medium web according to the embodiment.

Three smoothing rolls 34,46,48 which adhere the medium web 18 and liner web 32 together in cooperation with the abovementioned second corrugating roll 16 at the operation position are disposed in an appointed relationship between the abovementioned main frames 10,10. That is, the first smoothing roll 34 is rotatably disposed in the feeding path of the abovementioned liner web 32, and the liner web 32 wound on the first smoothing roll 34 is fed toward the second corrugating roll 16. The first smoothing roll 34 is such that its rotation shaft 34*a* is pivotally supported with respect to the main frames 10,10, and as shown in FIG. 7, and a motor 52 with a brake which functions as an adjusting means is connected, via a speed reducer 50, to the end portion of the rotation shaft 34*a* extending from the main frame 10 at the drive side. Accordingly, the motor 52 with a brake is actuated and controlled by a production control apparatus 100 which acts as a controlling means shown in FIG. 8, where the rotation speed (peripheral speed) $V_1$ of the first smoothing roll 34 is controlled so as to be equal to or less than the rotation speed (peripheral speed) $V_0$ of the abovementioned second corrugating roll 16 ($V_1 \leqq V_0$). Furthermore, since the rotation speed of the second corrugating roll 16 is set to be equal to the feeding speed of the abovementioned liner web 32, the rotation speed of the first smoothing roll 34 becomes less than the feeding speed of the liner web 32.

Figure 2:
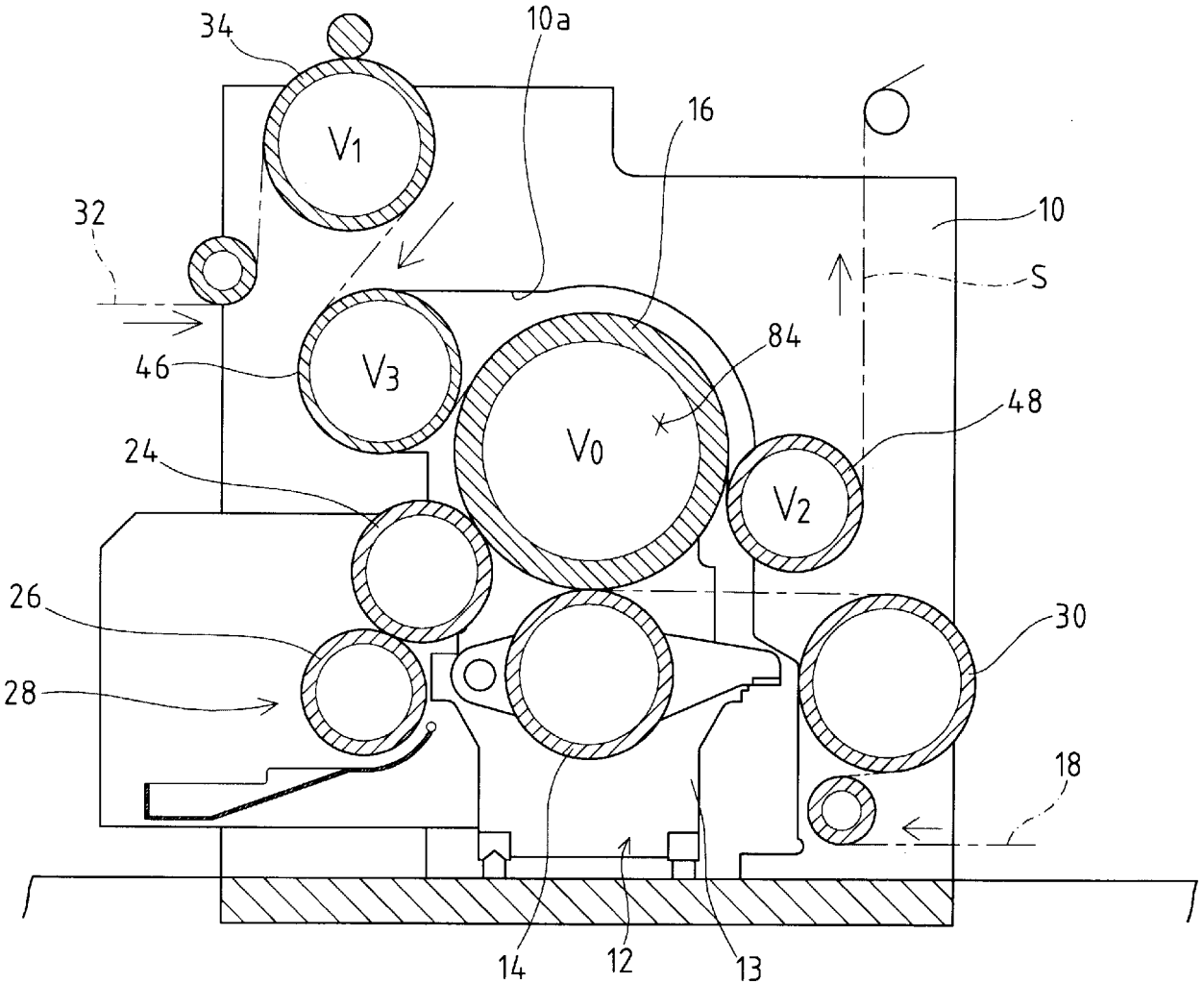
FIG. 2 is a rough longitudinally sectional view of a producing apparatus according to the embodiment.

The second smoothing roll 48 is rotatably disposed at the downstream side of the abovementioned first smoothing roll 34 opposite to the second corrugating roll 16 in a feeding channel of a single face corrugated web for which the medium web 18 and liner web 32 are adhered to each other. Furthermore, the second smoothing roll 48 is, as shown in FIG. 2, positioned in such relationship that the medium web 18 and liner web 32 are not pressure-contacted to the second corrugating roll 16. As shown in FIG. 3, a belt pulley 66 is disposed at the rotating shaft 48*a* of the second smoothing roll 48 extending from the main frame 10 at the abovementioned drive side, and a belt 68 is applied between the corresponding belt pulley 66 and a belt pulley 62 disposed at the speed reducer 36 of the abovementioned second corrugating roll 16, whereby the corresponding second smoothing roll 48 is constructed so as to be driven and rotated by the main drive motor 38. Furthermore, the belt pulley 66 of the abovementioned second smoothing roll 48 is set to such a dimension where the rotation speed (peripheral speed) $V_2$ of the second smoothing roll 48 becomes faster than the rotation speed (peripheral speed) $V_0$ of the second corrugating roll 16 (that is, $V_0<V_2$). That is, the relationship between the rotation speed $V_1$ of the abovementioned first smoothing roll 34 and the rotation speed $V_2$ of the second smoothing roll 48 is $V_1<V_2$, wherein a liner web 32 fed between the rolls 34 and 48 is given an appointed tension.

Figure 9:
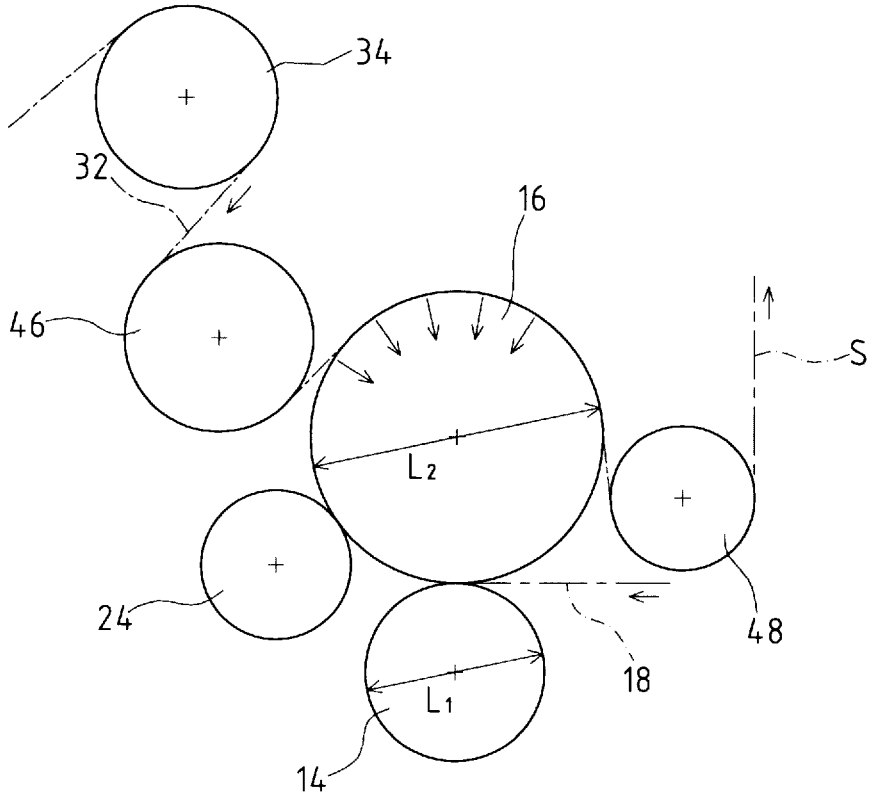
FIG. 9 is a rough configurational view of a producing apparatus, in which the third smoothing roll is positioned at a non-pressure-contacted position, according to the embodiment.

The third smoothing roll 46 on and by which the liner web 32 passing through the first smoothing liner web 34 is wound and guided is rotatably disposed between the abovementioned main frames 10 and 10 in a feeding channel of the liner web 32 between the abovementioned first smoothing roll 34 and the second smoothing roll 48. And the third smoothing roll 46 is positioned so that the liner web 32 confronting between the roll 46 and the abovementioned second smoothing roll 48 is caused to travel on one-fourth or more of the peripheral length of the abovementioned second corrugating roll 16 along the outer circumferential surface of the second corrugating roll 16. Thereby, the tension given to the liner web 32 by a difference in the rotation speed between the first smoothing roll 34 and the second smoothing roll 48 acts, as shown in FIG. 9, as a pressing force with which the liner web 32 presses the medium web 18, which is fed along the outer circumferential surface of the abovementioned second corrugating roll 16, toward the second corrugating roll 16. Thereby, it is constructed so that the medium web 18 is adhered to the liner web 32. Furthermore, it is favorable that the pressure-contacting distance where the liner web 32 travels along the outer circumferential surface of the second corrugating roll 16 is more than 300 mm. In order to keep this distance and to achieve a satisfactory heat efficiency, it is highly recommended that a second corrugating roll 16 having a diameter of 400 mm or more is used.

As shown in FIG. 3, a belt 68 wound on the belt pulley 66 of the abovementioned second smoothing roll 48 is commonly wound on the belt pulley 64 disposed at the rotation shaft 46*a* of the abovementioned third smoothing roll 46 and the corresponding third smoothing roll 46 is driven and rotated by the main drive motor 38. Furthermore, the belt 64 of the third smoothing roll 46 is set to such a dimension where the relationship between the rotation speed (peripheral speed) $V_3$ of the third smoothing roll 46 and the rotation speed (peripheral speed) $V_0$ of the second corrugating roll 16 becomes $V_3 \leqq V_0$. Furthermore, it is recommended that the outer circumferential surface of the abovementioned first smoothing roll 34 and the third smoothing roll 46 is satin-finished or is wrapped with urethane in order to increase a contacting resistance so that adequate tension is given to the liner web 32 without fail.

As shown in FIG. 1, the abovementioned third smoothing roll 46 is pivotally supported at supporting plates 56 and 56 (only one is illustrated) rockably disposed at the main frames 10 and 10, and it is constructed so that by normally or reversely pressing the respective supporting plates 56 by a fluid pressure cylinder 58 as a corresponding displacement means, the rotation center of the corresponding roll 46 is displaced, and draws near or is separated from the second corrugating roll 16. The fluid pressure cylinder 58 is actuated and controlled by the abovementioned production control apparatus 100, wherein in compliance with a change in any one of the conditions such as paper quality, paper width, production speed, etc., of the medium web 18 and liner web 32, or a change in combinations of these factors, the third smoothing roll 46 is set so as to selectively move between a non-contacted position (FIG. 9) where the medium web 18 and liner web 32 are not pressure-contacted with respect to the second corrugating roll 16, and a contacted position (FIG. 10) where they are pressure-contacted. Furthermore, the third smoothing roll 46, according to the preferred embodiment, is constructed so as to be movable to a flute roll replacement position, which is greatly spaced from the second corrugating roll 16, separately from the non-contacted position and contacted position. When moving the abovementioned carrier 12 to its retracted position from the main frames 10 and 10 in replacing both corrugating rolls 14 and 16, the corresponding third corrugating roll 46 is caused to move to the flute roll replacement position by the fluid pressure cylinder 58. Furthermore, an adjustment device 60, in which an eccentric mechanism is adopted, is incorporated in the pivotal portion of the abovementioned supporting plates 56 and 56, wherein when the third smoothing roll 46 is positioned at the contacted position, the nipping pressure adjustment at the third smoothing roll 46 is able to be carried out by the corresponding adjustment device 60. The adjustment device 60 is actuated and controlled by the production control apparatus 100 in compliance with a change in any one of paper quality, paper width, production speed, etc., of the medium web 18 or liner web 32, or a change in combinations in any of these factors.

The abovementioned third smoothing roll 46 and the second smoothing roll 48 are connected to a supply source of heated steam (not illustrated), in order to circulate high temperature steam into the corresponding rolls, whereby the temperature of the roll surfaces is increased to an appointed temperature level. Accordingly, the liner web 32 in contact with both smoothing rolls 46 and 48 is heated, wherein heat is given to the gluing portion of the abovementioned medium web 18 and liner web 32 in order to accelerate gelling of starch-based glue, thereby causing the adhering of the medium web 18 and liner web 32 to be carried out without fail.

Figure 8:
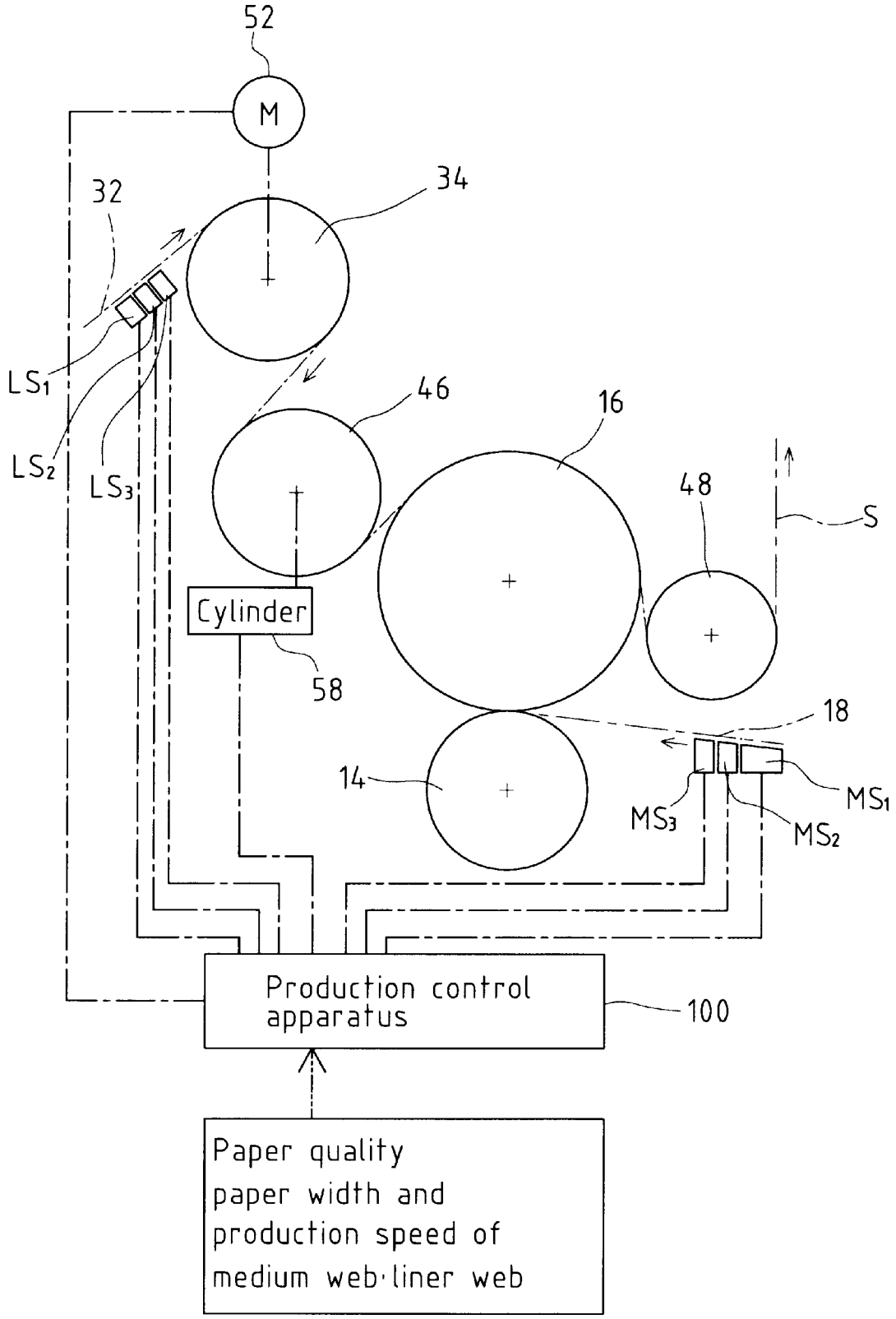
FIG. 8 is a control block diagram of a producing apparatus according to the embodiment.

As shown in FIG. 8, a paper quality sensor $MS_1$, paper width sensor $MS_2$, and production speed sensor $MS_3$ are disposed in the feeding channel of the abovementioned medium web 18 as detecting means to correspondingly detect the paper quality, paper width and production speed of the corresponding medium web 18, and it is constructed so that detection signals of the respective sensors $MS_1$, $MS_2$ and $M_3$ are inputted into the production control apparatus 100. Furthermore, a paper quality sensor $LS_1$, paper width sensor $LS_2$ and production speed sensor $LS_3$ which correspondingly detect the paper quality, paper width and production speed of the corresponding liner web 32 are similarly provided in the feeding channel of the liner web 32, wherein detection signals of the respective sensors $LS_1$, $LS_2$ and $LS_3$ are inputted into the production control apparatus 100. And the production control apparatus 100 actuates and controls the abovementioned motor 52 with a brake upon receiving input signals from the respective sensors, varies the difference in the rotation speed between the first smoothing roll 34 and the second smoothing roll 48, and controls to displace the rotation center of the third smoothing roll 46 by actuating and controlling the abovementioned fluid pressure cylinder 58. Furthermore, the production control apparatus 100 is provided with reference values used in selecting any one of the contacted positions or non-contacted positions of the third smoothing roll 46, wherein the detection value by each sensor is lower than the reference value, the third smoothing roll 46 is caused to move to the non-contacted position, and if being higher than the reference value, the third smoothing roll 46 is caused to move to the contacted position. Furthermore, "paper quality" in the embodiment is defined as that it includes thickness, weight, etc.

(Actions of the Embodiment)

Next, a description is given of actions of an apparatus for producing single face corrugated web according to the abovementioned embodiment. By driving and rotating the second corrugating roll 16 by the abovementioned main drive motor 38, the first corrugating roll 14 is driven and rotated in accordance with an engagement action of the corrugation fluted portion. Detection signals coming from each of the paper quality sensors $MS_1$, $LS_1$, paper width sensors $MS_2$, $LS_2$, and production speed sensors $MS_3$, $LS_3$, which are disposed in the feeding channel of the abovementioned medium web 18 and liner web 32, are inputted into the abovementioned production control apparatus 100, wherein the rotation speed of the abovementioned first smoothing roll 34 is established on the basis of the detection value, and the third smoothing roll 46 is positioned. That is, if the detection value of each of the abovementioned sensors is lower than the preset reference value and the production control apparatus 100 judges that no pressure contact is required at the abovementioned third smoothing roll 46, the abovementioned fluid pressure cylinder 58 is actuated and controlled, and the third smoothing roll 46 is caused to move to the non-contacted position shown in FIG. 9 and is positioned there.

In this state, the medium web 18 supplied from the material paper source into the area of engagement of the first corrugating roll 14 with the second corrugating roll 16 via the medium web preheater 30 is formed to an appointed flute shape by passing through the abovementioned area. The medium web 18 thus fluted is stably fed toward the abovementioned gluing mechanism 28 in such a state where it is adsorbed and retained at the outer circumferential surface of the roll 16 by negative pressure created in the respective peripheral grooves 82 of the second corrugating roll 16. Accordingly, after the corrugation crests of the medium web 18 are glued by a gluing mechanism 28, the abovementioned medium web 18 is caused to go upward with its feeding direction reversed along the outer circumferential surface of the second corrugating roll 16 (See FIG. 9). Furthermore, since in the embodiment the second corrugating roll 16 of a large diameter is positioned right above the first corrugating roll 14, efficient nipping pressure is given to the medium web 18 at the area of engagement, and secure flute formation can be carried out. Furthermore, since both corrugating rolls 14 and 16 are disposed at the sub frames 13 and 13 of the carrier 12 structurally separated from the main frames 10 and 10, vibration generated between both corrugating rolls 14 and 16 are not transmitted to the main frames 10 and 10, wherein there is an effect by which vibration and noise incidental therewith can be suppressed.

Furthermore, a liner web 32 supplied from the material paper supply source to the third smoothing roll 46 via the abovementioned first smoothing roll 34 is supplied to the arranged position of the second smoothing roll 48 along the outer circumferential surface of the second corrugating roll 16. In this case, appointed tension is given to the liner web 32 between both rolls 34 and 48 by the difference in the rotation speed between the abovementioned first smoothing roll 34 and the second smoothing roll 48. And since the liner web 32 is caused to travel an appointed distance along the outer circumferential surface of the second corrugating roll 16 by the abovementioned third smoothing roll 46, the medium web 18 and liner web 32 supplied along the outer circumferential surface of the second corrugating roll 16 are pressure-contacted to the outer circumferential surface of the second corrugating roll 16 over an appointed distance by tension given to the liner web 32 as shown in FIG. 9, and the medium web 18 and liner web 32 are adhered to each other, thereby producing a single face corrugated web.

Negative pressure is created over the entire circumference of the respective peripheral grooves 82 of the abovementioned second corrugating roll 16, and the medium web 18 is adsorbed to and retained on the outer circumferential surface of the second corrugating roll 16 by negative pressure at the entire area where the abovementioned medium web 18 and liner web 32 are pressure-contacted to the second corrugating roll 16. Accordingly, with the adsorption power resulting from the negative pressure, the water content of the glue liquid at the position, at which the medium web 18 and liner web 32 are adhered to each other, is absorbed to cause the drying thereof to be accelerated, wherein it is possible to securely achieve a gluing and adhering of both 18 and 32 at a high speed operation.

Thus, in a case where the abovementioned third smoothing roll 46 is caused to confront the non-contacted position, the medium web 18 and liner web 32 confronting between the third smoothing roll 46 and the second smoothing roll 48 are pressure-contacted and adhered to each other other by only tension. Therefore, no hammering phenomena described above is permitted to occur, there is no fear that any press mark is given to the liner webide of a single face corrugated web, and further, vibrations and/or noise which may be generated in producing a single face corrugated web are able to be suppressed. Furthermore, by setting the diameter of the second corrugating roll to 150% or more of the diameter of the first corrugating roll 14, greater pressure-contacted area of the medium web 18 and liner web 32 confronting between the third smoothing roll 46 and the second smoothing roll 48 with respect to the second corrugating roll 16 can be obtained. That is, the time during which the medium web 18 and liner web 32 are in contact with the second corrugating roll 16 can be sufficiently lengthened even if the production speed is increased, wherein sufficient heat is given from the second corrugating roll 16 to the medium web 18 and liner web 32 in order to achieve a secure adhering of both. Therefore, capacity can be increased by high speed production.

Figure 10:
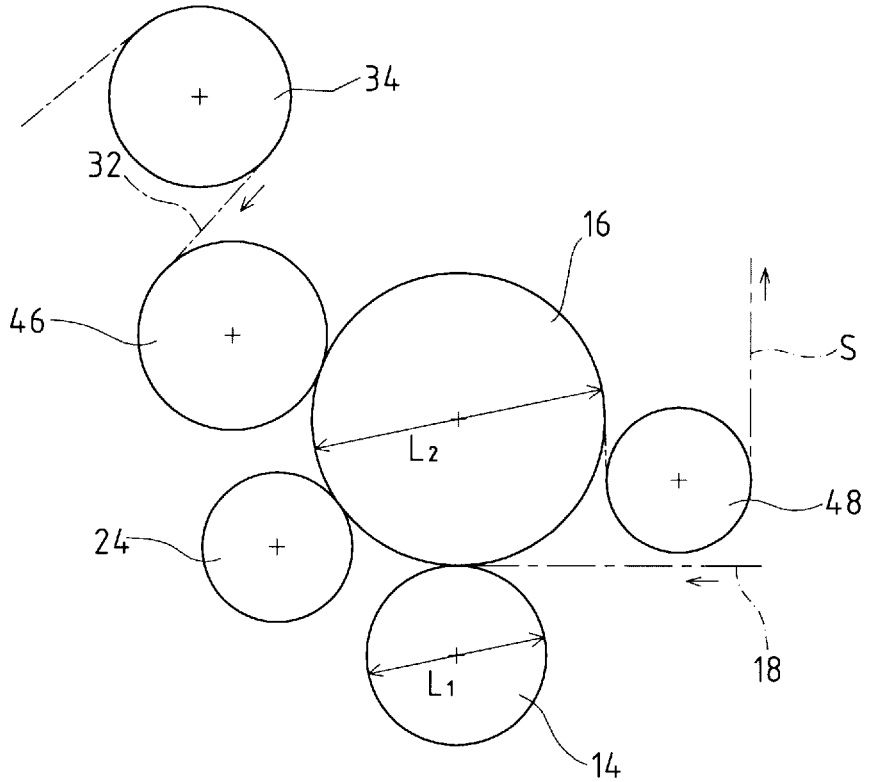
FIG. 10 is a rough configurational view of a producing apparatus, in which the third smoothing roll is positioned at a pressure-contacted position, according to the embodiment.

Next, if the values detected by the abovementioned paper quality sensors $MS_1$, $LS_1$, paper width sensor $MS_2$, $LS_2$ and production speed sensor $MS_3$, $LS_3$ are higher than the preset reference values and the production control apparatus 100 judges that it is necessary to provide pressure contacting by the third smoothing roll 46, the fluid pressure cylinder 58 is actuated and controlled to move and position the third smoothing roll 46 to the pressure-contacting position shown in FIG. 10. Furthermore, since the abovementioned adjustment device 60 is also actuated and controlled by the production control apparatus 100, the nipping pressure is adjusted by the third smoothing roll 46.

That is, in a case where the third smoothing roll 46 is positioned at the pressure contacting position, a liner web 32 supplied from the abovementioned first smoothing roll 34 to the third smoothing roll 46 is preliminarily adhered to the medium web 18 supplied along the outer circumferential surface of the second corrugating roll 16 by appointed nipping pressure. Thereafter, the medium web 18 and liner web 32 are completely adhered to each other by the tension produced by a difference in the rotation speed between the first smoothing roll 34 and the second smoothing roll 48. Furthermore, in this case, the nipping pressure produced by the third smoothing roll 46 and tension are concurrently utilized, the nipping pressure of the third smoothing roll 46 can be set to such a small value by which no press mark is given to the liner webide, whereby it is possible to prevent any press marks from being generated. That is, a small value by which no press mark is given to the liner webide is about one-third to one-fifth of the nipping pressure in the conventional single face corrugated web production apparatus, and this is a slight value in comparison with the conventional value.

(Modifications)

Figure 11:
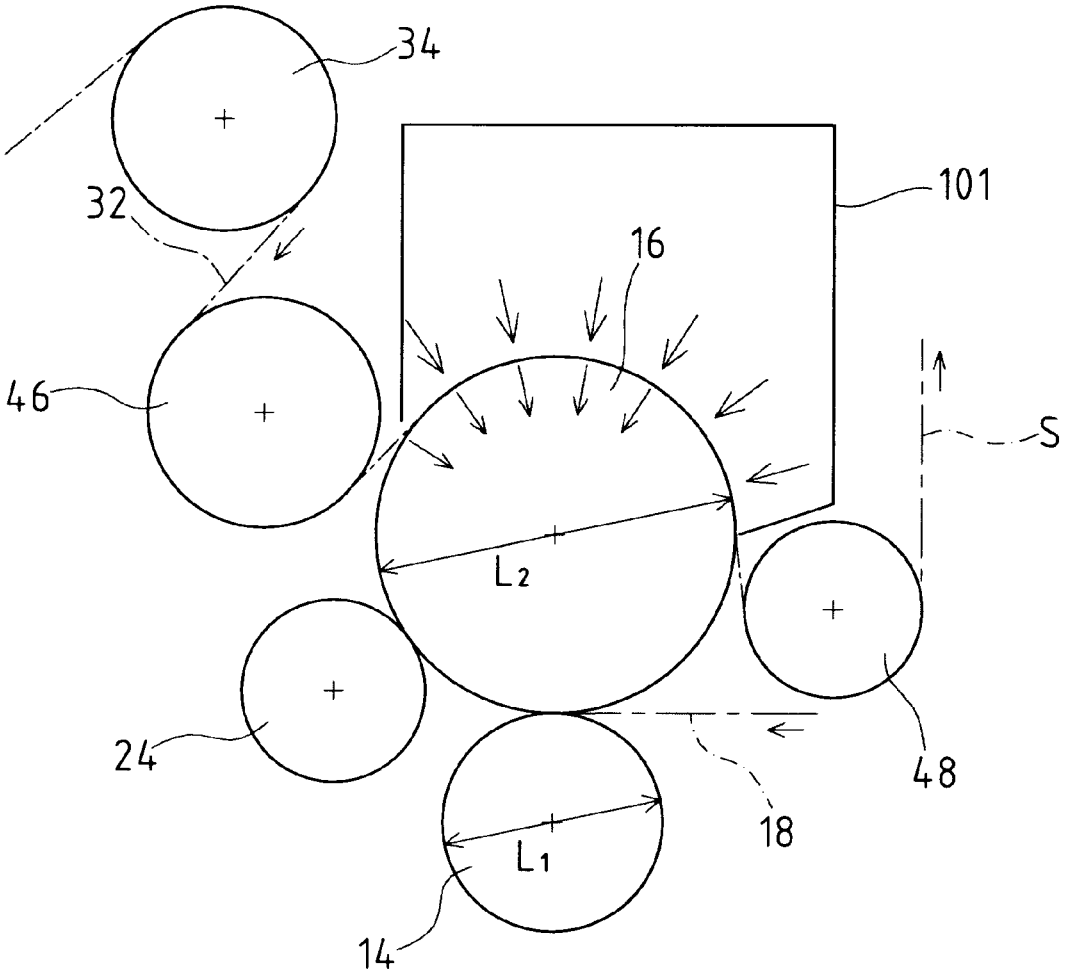
FIG. 11 is a rough configurational view of a producing apparatus according to another embodiment.

The present invention is not limited to the abovementioned embodiment. It is easily understood that various modifications and variations are included in the invention. For example, as shown in FIG. 11, such a construction may be employed, where a compression case 101 which covers the area where the liner web 32 travels along the outer circumferential surface of the second corrugating roll is provided between the third smoothing roll 46 and the second smoothing roll 48, compressed air is supplied from a supply source into the compression case 101 to produce the compressed state in the case 101, and the liner web 32 and medium web 18 are pressed to the outer circumferential face of the second corrugating roll 16. Although the embodiment employs a construction where the medium web is retained on the entire circumferential surface by making the negative pressure path internally formed in the second corrugating roll negative, such a construction may be employed, in which negative pressure is created in the peripheral grooves of the second corrugating roll by an external suction source, and the medium web is retained only from the engagement position with the first corrugating roll with respect to the second corrugating roll to the pressure contact commencing end position with a liner webtill furthermore, such a construction may be employed, where a compression chamber which covers an area from the abovementioned engagement position to the pressure contact commencing end position is provided and the pressure inside the compression chamber is made higher than the atmospheric pressure, whereby the medium web is pressed to the outer circumferential face of the second corrugating roll. Furthermore, such a construction may also be employed, in which dry air is supplied into the trough portions on the outer circumferential face of the second corrugating roll from the axial direction in order to accelerate drying the water content of glue liquid.

As a means for varying the rotation speed of the abovementioned first smoothing roll, a powder brake or a mechanical braking means disposed separately from the motor may be employed. Furthermore, a means for displacing the rotation center of the abovementioned third smoothing roll is not limited to a fluid pressure cylinder (hydraulic or pneumatic) of the embodiment, and such an eccentric mechanism in which a motor is used may be employed. Furthermore, the nipping pressure adjustment of the third smoothing roll is not separately carried out by an adjustment device, and the adjustment may be performed by controlling the supply quantity (or supply pressure) of fluid (hydraulic or pneumatic) into the fluid pressure cylinder with the adjusting device omitted. In this case, the adjustment work may be remarkably simplified.

As regards adjustment of the difference in the rotation speed between the abovementioned first smoothing roll and the second smoothing roll and displacement of the rotation center of the third smoothing roll, such a construction may be employed, where various kinds of conditions such as paper quality, paper width, production speed, etc. of medium web and liner web are preset in the abovementioned production control apparatus (See FIG. 8), the input data is selected in changing orders, and the difference in the rotation speed between the first smoothing roll and the second smoothing roll and the position of the rotation center of the third smoothing roll are automatically adjusted. Furthermore, such a construction may be employed, where an operator manually adjusts the adjusting means (motor with brake) and displacing means (fluid pressure cylinder), whereby it is possible that the operator is able to adjust the difference in the rotation speed and the displacing position by operating the corresponding means as necessary. Still furthermore, the first smoothing roll does not always necessarily rotate, wherein tension is given to the liner web by braking the liner weblidably supplied on the roll with the adjusting means retained at the stop state, or the first smoothing roll may be constructed of a fixed drum which is made unrotatable. Still furthermore, although in this embodiment the difference in the rotation speed between the first smoothing roll and the second smoothing roll is adjusted by varying the rotation speed of the first smoothing roll, this can be solved by varying the rotation speed by a construction and control which are similar to the above. And the third smoothing roll may be of such a construction where it is not driven by the main drive motor as in the embodiment, but it may be separated from the drive source and may rotate, following the travelling of the liner web.

Furthermore, a single face corrugated web produced by the corresponding single face corrugated web production apparatus is continuously supplied through a subsequent process via the abovementioned second smoothing roll and a sandwich conveyor, etc. However, the supplying speed of a single face corrugated web is set to a faster speed than the feeding speed of a liner web. Therefore, since appointed tension is given to the liner web between both rolls even though the difference in the rotation speed between the first smoothing roll and the second smoothing roll is zero ($V_1 = V_2$), adhering of the liner web and medium web can be achieved. For example, in a case where thin medium web and liner web are adhered to each other, both can be securely adhered to each other even though the rotation speed of the first smoothing roll is set to the same as that of the second smoothing roll.

As regards the abovementioned second smoothing roll, a description is given of a case where the medium web and liner web (single face corrugated web) are disposed at a position where they are not pressure-contacted to the second corrugating roll. However, the second smoothing roll is constructed so that it draws near or is separated from the second corrugating roll by a position adjusting apparatus of the eccentric mechanism, in which a fluid pressure cylinder and a motor are used, and the medium web and liner web are displaced to positions where they are pressure-contacted or not pressure-contacted to the second corrugating roll, in compliance with a change in any one of paper quality, paper width of the medium web or liner web, and production speed, or a change in combinations of these factors. That is, any one of these combinations may be selected, in which both of the second smoothing roll and third smoothing roll are at the non-pressure-contacted position or pressure-contacted position, or in which the third smoothing roll is at the pressure-contacted position while the second smoothing roll is at the non-pressure-contacted position or in which third smoothing roll is at the non-pressure-contacted position while the second smoothing roll is at the pressure-contacted position. Furthermore, the second smoothing roll is constructed so as to rotate by an independent motor, and the difference in the rotation speed between the first smoothing roll and the second smoothing roll may be changed by controlling the motor.

An arrangement of the abovementioned first corrugating roll and the second corrugating roll is not limited to such a construction in which the second corrugating roll is disposed right above the first corrugating roll as in this embodiment. The rotation center of the second corrugating roll may be disposed so as to be positioned diagonally upwards with respect to the rotation center of the corrugating roll and the rotation center of the second corrugating roll may be disposed diagonally downward with respect to the rotation center of the first corrugating roll. Still furthermore, in this embodiment, a description is given of a case where the diameter of the second corrugating roll is made greater than that of the first roll. However, they may be made with the same diameter.

What is claimed is:

1. An apparatus for producing a single face corrugated web by adhering a liner web and glued corrugation crests of a medium web, said apparatus comprising:

a first corrugating roll having corrugation flutes formed on an outer circumferential surface thereof;

a second corrugating roll having corrugation flutes formed on an outer circumferential surface thereof so as to be engaged with said corrugation flutes of said first corrugating roll, said second corrugation roll being heated and forming predetermined corrugation flutes on said medium web passing between said first and second corrugating rolls;

a gluing mechanism which carries out gluing at corrugation crests of said medium web on which said corrugation flutes are formed;

a first smoothing roll provided in a feeding channel of said liner web, a rotation speed of said first smoothing roll being set to be lower than a feeding speed of said liner web;

a second smoothing roll provided in a feeding channel of said single face corrugated web, a rotation speed of said second smoothing roll being set to be higher than a feeding speed of said liner web;

a third smoothing roll disposed in a feeding channel of said liner web between said first smoothing roll and said second smoothing roll and at a position where said liner web is guided so that a tension generated at said liner web by means of a difference in rotation speed of said first and second smoothing rolls is exerted toward said outer circumferential surface of said second corrugating roll, said third smoothing roll being driven in synchronism with said first smoothing roll;

a displacement means for selectively moving said third smoothing roll between a first position and a second position, said first position being where said third smoothing roll does not press said medium web and liner web against said second corrugating roll, and said second position being where said third smoothing roll presses said medium web and liner web against said second corrugating roll;

detecting means for detecting a paper quality, paper width and production speed of said respective medium web and liner web; and a control means for, based upon a detected result of said detecting means, changing a difference in rotation speed of said first smoothing roll and second smoothing roll to a desired value, setting said third smoothing roll at either one of said first position and said second position, and changing a nipping pressure between said third smoothing roll and said second corrugating roll to be a desired small value when said third smoothing roll is set at said second position; and wherein when said third smoothing roll is set at said first position, said medium web and liner web are adhered each other by heat that is received from said second corrugating roll with which said medium web is in contact and by said tension generated at said liner web; and when said third smoothing roll is set at said second position, said medium web and liner web are adhered each other by heat received from an appointed area of said circumferential surface of said second corrugating roll which is in contact with said medium web, tension generated at said liner web, and said desired nipping pressure of small value.

2. A method for producing a single face corrugated web for producing a single face corrugated web by adhering a liner web to glued corrugation crests of a medium web, said method comprising:

the step of preparing:

a first corrugating roll having corrugation flutes formed on an outer circumferential surface thereof, a second corrugating roll having corrugation flutes formed on an outer circumferential surface thereof so as to be engaged with said corrugation flutes of said first corrugating roll, said second corrugation roll being heated and forming predetermined corrugation flutes on said medium web passing between said first and second corrugating rolls, a gluing mechanism which carries out gluing at corrugation crests of said medium web on which said corrugation flutes are formed, a first smoothing roll provided in a feeding channel of said liner web, a rotation speed of said first smoothing roll being set to be lower than a feeding speed of said liner web, a second smoothing roll provided in a feeding channel of said single face corrugated web, a rotation speed of said second smoothing roll being set to be higher than a feeding speed of said liner web, and a third smoothing roll disposed in a feeding channel of said liner web between said first smoothing roll and said second smoothing roll and at a position where said liner web is guided, said third smoothing roll being driven in synchronism with said first smoothing roll;

the step of exerting a tension, which is generated at liner web by means of a difference in rotation speed of said first smoothing roll and second smoothing roll, toward an outer circumferential surface of said second corrugation roll;

the step of moving said third smoothing roll selectively between a first position and a second position, said first position being where said third smoothing roll does not press said medium web and liner web against said second corrugating roll, and said second position being where said third smoothing roll presses said medium web and liner web against said second corrugating roll;

the step of detecting a paper quality, paper width and production speed of said respective medium web and liner web; and the step of, based upon a detected result of said detecting means, changing a difference in rotation speed of said first smoothing roll and second smoothing roll to a desired value, setting said third smoothing roll at either one of said first position and said second position, and changing a nipping pressure between said third smoothing roll and said second corrugating roll to be a desired small value when said third smoothing roll is set at said second position; and wherein when said third smoothing roll is set at said first position, said medium web and liner web are adhered each other by heat that is received from said second corrugating roll with which said medium web is in contact and by said tension generated at said liner web; and when said third smoothing roll is set at said second position, said medium web and liner web are adhered each other by heat received from an appointed area of said circumferential surface of said second corrugating roll which is in contact with said medium web, tension generated at said liner web, and said desired nipping pressure of small value.

3. An apparatus for producing a single face corrugated web as set forth in claim 1, wherein said displacing means is a fluid pressure cylinder, and nipping pressure at said pressure contact position is adjusted by controlling fluid pressure supplied to the cylinder.

4. An apparatus for producing a single face corrugated web as set forth in claim 1, wherein the rotation speed of said third smoothing roll is set to be lower than a feeding speed of said liner web.

5. An apparatus for producing a single face corrugated web as set forth in claim 1, wherein the liner web fed between said first smoothing roll and second smoothing roll is set to travel by said third smoothing roll along the outer circumferential surface of said second corrugating roll over the distance equivalent to one-fourth or more of the outer circumferential length of the second corrugating roll.

6. An apparatus for producing a single face corrugated web as set forth in claim 5, wherein said liner web is caused to travel over the distance equivalent to 300 mm or more on the outer circumferential surface of the second corrugating roll.

7. An apparatus for producing a single face corrugated web as set forth in claim 6, wherein the diameter of said second corrugating roll is 400 mm or more.

8. An apparatus for producing a single face corrugated web as set forth in claim 1, wherein said first smoothing roll is maintained in a non-rotatable state by said adjusting means.

9. An apparatus for producing a single face corrugated web as set forth in claim 1, wherein said first smoothing roll is a non-rotatably fixed drum.

10. An apparatus for producing a single face corrugated web as set forth in claim 1, wherein said pair of corrugating rolls are disposed and installed at sub-frames structurally separated from the main frames on which a plurality of smoothing rolls are disposed.

* * * * *